US006485324B1

(12) United States Patent
Belknap

(10) Patent No.: US 6,485,324 B1
(45) Date of Patent: Nov. 26, 2002

(54) ADJUSTABLE ELECTRICAL CORD STRAIN RELIEF APPARATUS

(75) Inventor: Lee J. Belknap, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,617

(22) Filed: Sep. 27, 2001

(51) Int. Cl.[7] ..... H01R 13/58
(52) U.S. Cl. ..... 439/457; 439/369
(58) Field of Search ..... 439/369, 459, 439/367, 465

(56) References Cited

U.S. PATENT DOCUMENTS

| | | | | | |
|---|---|---|---|---|---|
| 2,252,553 | A | * | 8/1941 | Campbell | 439/465 |
| 2,386,000 | A | * | 10/1945 | McQuiston | 439/465 |
| 2,721,313 | A | * | 10/1955 | English | 439/369 |
| 3,720,906 | A | * | 3/1973 | Punako et al. | 439/369 |
| 3,781,761 | A | * | 12/1973 | Harwood | 439/369 |
| 3,867,006 | A | * | 2/1975 | Jeffress | 439/465 |
| 3,922,055 | A | * | 11/1975 | McGregor | 439/369 |
| 4,504,106 | A | * | 3/1985 | Fechter | 439/369 |
| 4,723,822 | A | * | 2/1988 | Merdic | 439/502 |
| 4,773,874 | A | * | 9/1988 | Kopeski, Jr. | 439/369 |
| 5,259,782 | A | * | 11/1993 | Griffin | 439/369 |
| 5,285,349 | A | * | 2/1994 | Zander et al. | 439/465 |
| 5,336,106 | A | * | 8/1994 | Osten | 439/369 |
| 5,423,693 | A | * | 6/1995 | Light | 439/369 |
| 5,443,397 | A | * | 8/1995 | Carl | 439/369 |
| 5,514,004 | A | * | 5/1996 | Swanson | 439/369 |
| 5,695,356 | A | * | 12/1997 | Swanson | 439/369 |
| 5,762,515 | A | * | 6/1998 | Mele | 439/369 |
| 6,012,940 | A | * | 1/2000 | Wheeler | 439/369 |
| 6,056,580 | A | * | 5/2000 | Cross et al. | 439/369 |

* cited by examiner

*Primary Examiner*—P. Austin Bradley
*Assistant Examiner*—Briggitte R. Hammond
(74) *Attorney, Agent, or Firm*—Fay, Sharpe, Fagan, Minnich & McKee, LLP

(57) ABSTRACT

A form has a zigzag shape, around which an associated electrical cord is wrapped over and under a plurality of times. The form preferably includes at least a portion having a shape corresponding to one of a sine wave, a square wave, a triangle wave, a continuously curved wave, and a "Z"-shape. The form is preferably retained near an electrical device by a retaining element. The retaining element preferably includes at least one of a partially blocked conduit, a narrowing conduit, a partially blocked tube, a bent tube, and a narrowing tube. The conduit preferably receives the form therein. The interfaces of the associated cord and the form preferably effectuate a frictional locking therebetween.

12 Claims, 7 Drawing Sheets

ADJUSTABLE ELECTRICAL CORD STRAIN RELIEF APPARATUS

BACKGROUND OF INVENTION

The invention relates to the electrical power arts. It is especially applicable to strain relief of electrical cords used in home appliances such as lamps, toasters, blenders, radios, coffee makers, and the like. However, the invention will find application in other situations where a cord or supply line provides a consumable element, such as electricity, a fluid, pressurized air, or the like, to a device or apparatus.

Electrical appliances typically receive electrical power via an electrical cord that connects the appliance to an electrical outlet. In the most common situation, a two-wire or three-wire electrical cord is permanently connected to the appliance at a first end and has a two-prong plug or a three-prong grounded plug a second end that connects to an electrical wall receptor to receive electrical power. The attachment of the first end of the cord to the appliance must be physically restrained to prevent the cord from detaching therefrom. Detachment disadvantageously interrupts power to the appliance and requires repair of the cord attachment. Furthermore, physical cord detachment or less drastic damage of the electrical connection of the first end to the appliance due to inadequate strain relief can pose serious electrical shock and fire safety hazards. For these reasons, cord strain relief mechanisms are typically required to meet regulatory agency pull requirements.

A strain relief apparatus for use in conjunction with an electrical cord should meet several additional criteria. Because electrical cords usually connect to an appliance through an electrical conduit, hook, or tube, the strain relief apparatus should be capable of being installed into the conduit, hook, or tube prior to assembly of the unit. This means that the strain relief apparatus should be smaller than the hole that the threaded conduit, hook, or tube is inserted into, and should not interfere with the installation thereof. However, the strain relief apparatus should also be large enough to prevent passage of the apparatus through the exposed end of the conduit, hook, or tube.

Several methods have been used in the past to provide strain relief for electrical cords. A simple method is to place a knot into the cord whereby the end of the cord is prevented from passing through the conduit. Other strain relief devices include a clamping mechanism that restrains the cord. Yet another approach is to use a series of posts to restrain the cord. These prior art approaches have the disadvantage of not always being easily incorporated into a given design because they are not easily applied to the inside of a conduit.

The present invention contemplates an improved electrical cord strain relief apparatus that overcomes the above-mentioned limitations and others.

SUMMARY OF INVENTION

In accordance with one aspect of the present invention, a strain relief apparatus is disclosed for providing strain relief near the connection of an associated electrical cord with an associated electrical device. A form has a zigzag shape, around which the associated electrical cord is wrapped over and under a plurality of times.

In accordance with another aspect of the present invention, an electrical apparatus is disclosed. An electrical device has an electrical cord with a first end of the cord connected to the electrical device. The cord has a second end adapted to connect with a source of electrical power. A strain relief device is operatively connected with the electrical cord and the electrical device. The strain relief device includes a conduit attached by an end thereof to the electrical device, and a zigzag shaped form disposed inside the conduit and around which the electrical cord is wrapped over and under a plurality of times.

In accordance with yet another aspect of the present invention, a strain relief apparatus for providing strain relief at an exit point of an associated cord from an associated body is disclosed. A conduit is attached to the associated body. A frictional locking element is disposed inside the conduit and frictionally locks onto the associated cord.

BRIEF DESCRIPTION OF DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION

Figure 1:
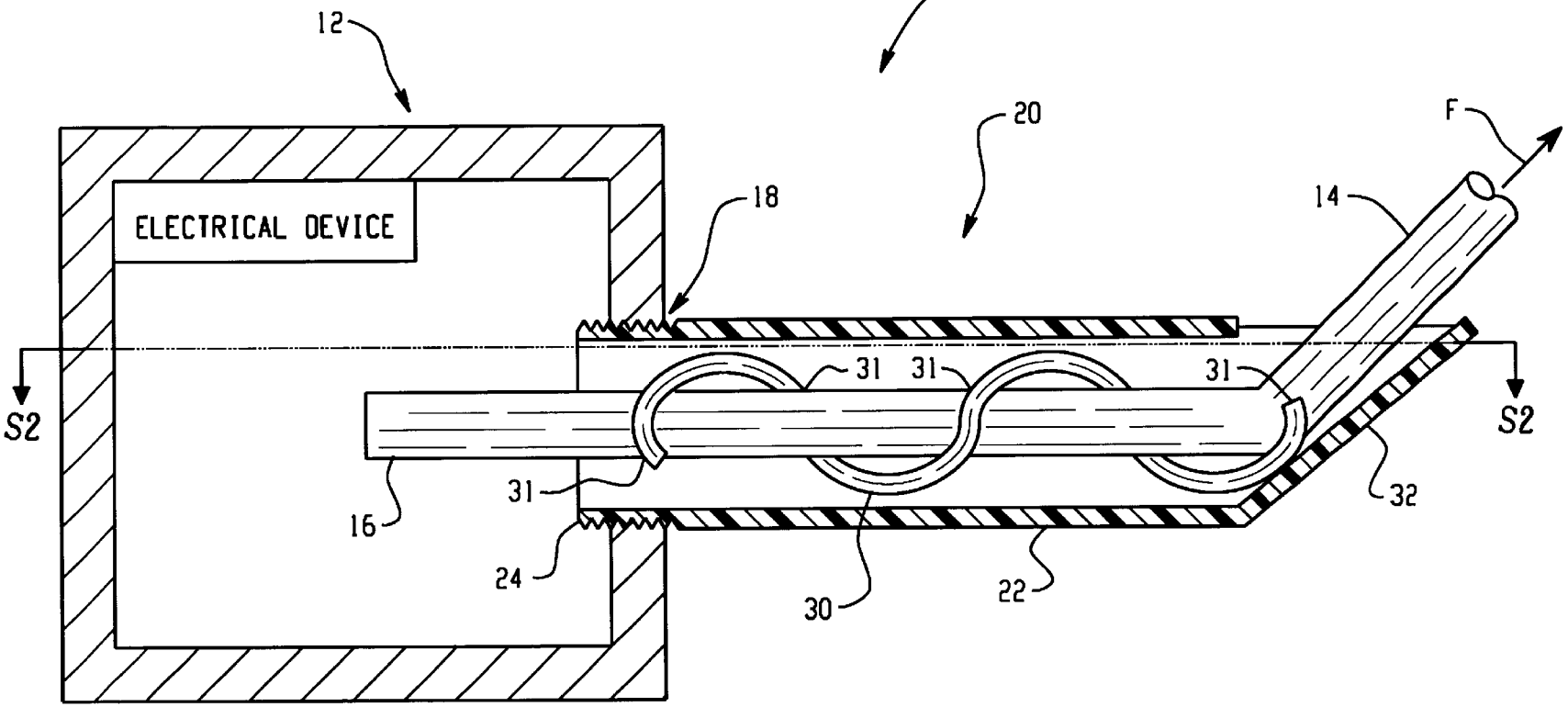
FIG. 1 shows a side sectional view of an electrical cord connection having strain relief according to a preferred embodiment of the invention.
Figure 2:
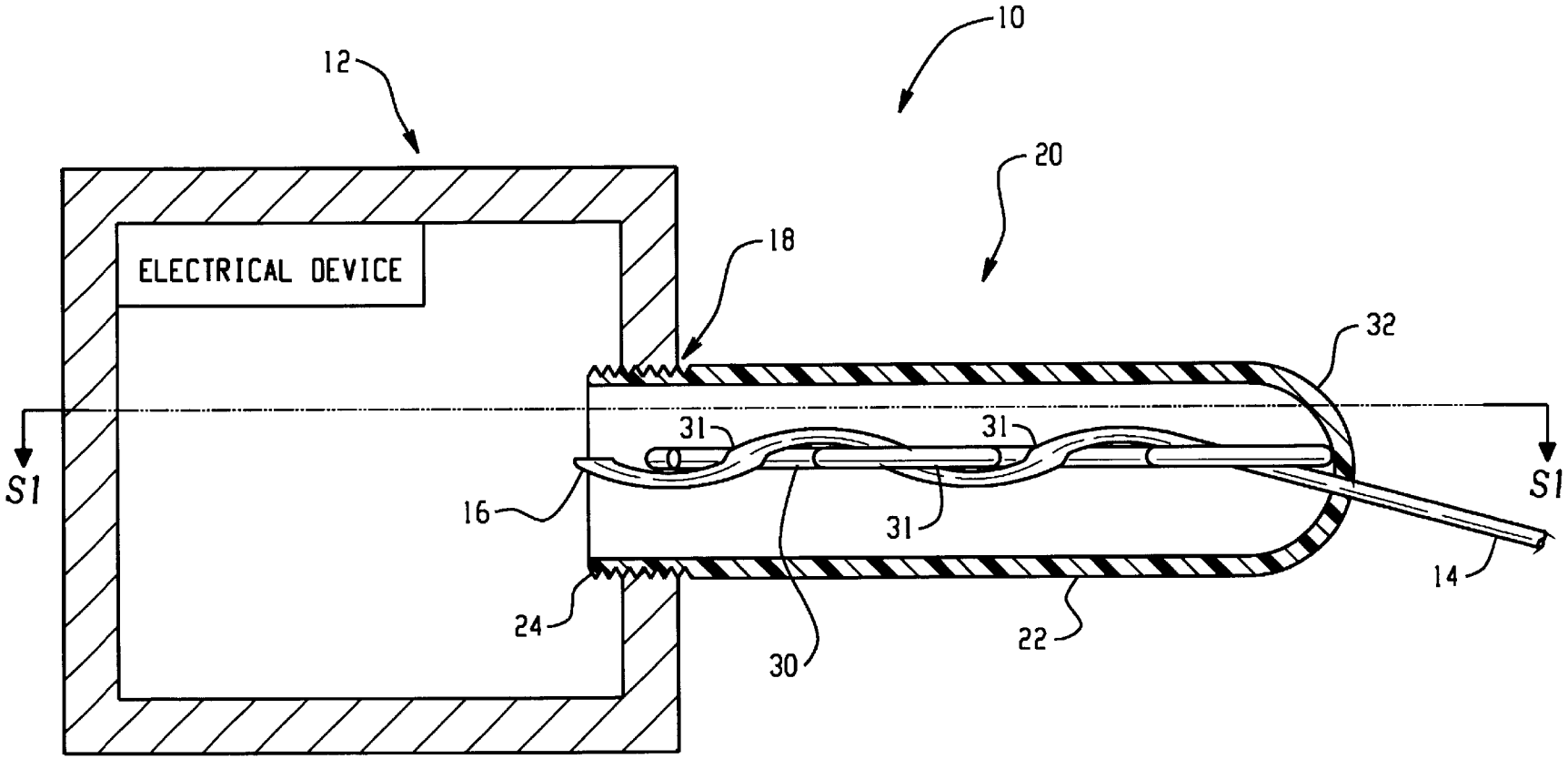
FIG. 2 shows a top sectional view of the electrical cord connection of FIG. 1.

With reference to FIGS. 1 and 2, an electrical apparatus 10 is described. FIG. 1 includes a Section S2—S2 line that indicates the sectional view shown in FIG. 2, and likewise FIG. 2 includes a Section S1—S1 that indicates the sectional view shown in FIG. 1. The electrical apparatus 10 includes an electrical device 12, such as a lighting fixture, cooking appliance, a radio, a coffee maker, or the like. The electrical device 12 receives electrical power from an associated power outlet (not shown), such as but not limited to a typical 110 volt electrical wall outlet, via an electrical cord 14. The electrical cord 14 typically includes two or three wires (not shown) depending upon whether the cord 14 includes a ground line. The cord 14 also includes an insulating covering disposed over the wires which serves to electrically isolate the wires from each other and from contact with outside elements.

The cord 14 includes a first end l6 that is connected to the electrical device. The connection of the first end l6 to the electrical device typically includes an opening 18 of the electrical device 12 through which the cord 14 passes. The wires of the first end 16 of the cord 14 are preferably soldered or crimped to electrically connect the cord 14 with an electrical power receiving section of the electrical device 12. The cord 14 also includes a second end (not shown) adapted to connect with a source of electrical power. For example, the second end preferably terminates in a two-prong or a three-prong electrical plug (not shown) of a type compatible with a typical 110 volt electrical wall outlet.

The electrical apparatus 10 also includes a strain relief device 20. A conduit 22, preferably tubular, is arranged over a portion of the cord 14. The conduit 22 has an end 24 that is attached to the electrical device 12, such as by a threaded connection to the opening 18. The end 24 may be arranged with respect to the opening 18 of the electrical device 12 such that, starting from the first end 16, the cord 14 passes through the opening 18 and the conduit 22 to the exterior of the electrical device 12. A frictional locking element 30, in one embodiment a zigzag shaped form, is disposed inside the conduit 22 and retained therein by an angular blockage 32 formed into the conduit 22. The cord 14 is preferably wrapped over and under the zigzag shaped form 30 a plurality of times to effectuate a frictional locking therebetween. The frictional locking element 30 is preferably wrapped around cord 14, and placed within the interior of conduit 22 prior to connection of cord 14 to electrical device 12.

In a preferred embodiment, the frictional locking element 30 includes a zigzag form manufactured from a metal, rubber, plastic or other appropriate material. A surface of the form 30 and a surface of the covering of cord 14 preferably form interfaces at the contact points 31 between the form 30 and the cord 14 . These contact point effectuate a frictional locking therebetween when the cord 14 is pulled with a force F. Particularly, as force F is applied, the zigzag shape of locking element 30 inhibits a straight pulling force on that part of cord 14 engaged with locking element 30. Rather, one portion of cord 14, engaged with locking element 30, will be in a separate plane from another portion of cord 14. Having the multiple contact points in different planes increases the frictional locking of the cord 14.

With reference now to FIGS. 3 through 7, several alternate embodiments of the frictional locking element 30 are described.

Figure 3:
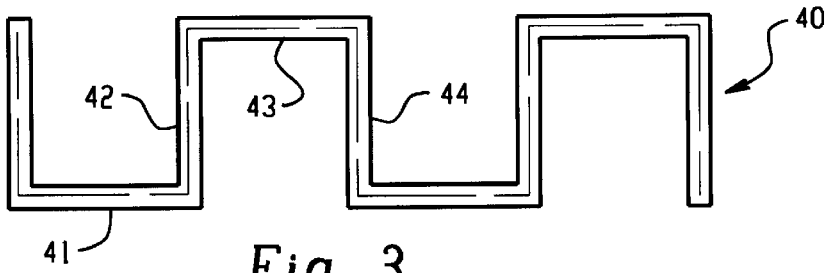
FIG. 3 shows a first preferred embodiment of the zigzag structure of the strain relief apparatus.

With reference to FIG. 3, a square wave form 40 embodiment of the frictional locking element is shown.

Figure 4:
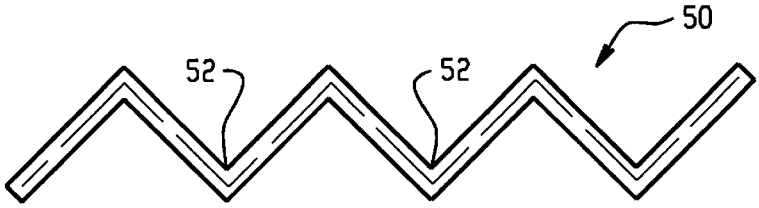
FIG. 4 shows a second preferred embodiment of the zigzag structure of the strain relief apparatus.

With reference to FIG. 4, a triangle wave form 50 embodiment of the frictional locking element is shown.

Figure 5:
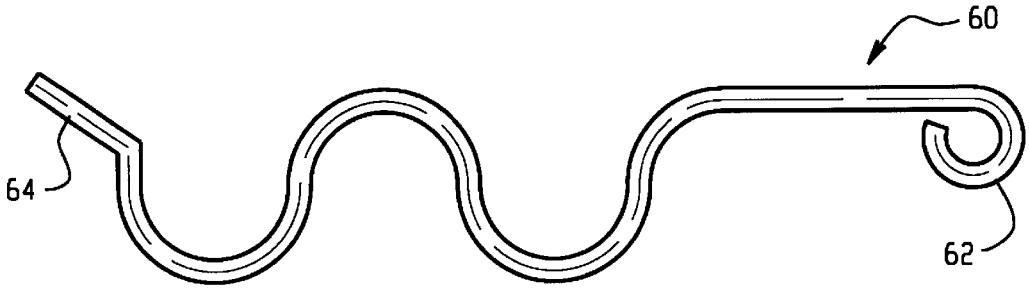
FIG. 5 shows a third preferred embodiment of the zigzag structure of the strain relief apparatus.

With reference to FIG. 5, another embodiment of a frictional locking element 60 is shown, that has a continuously curved wave shape. The form 60 also has a loop 62 disposed at an end thereof. The loop 62 eliminates a sharp cutoff of the form 60 and thus prevents damage to the associated cord by the end of the form 60. Additionally, the form 60 includes a straight section 64 at another end of the form 60. The straight section 64 advantageously cooperates with the conduit or other retaining means to maintain the friction locking element 60 in place.

Figure 6:
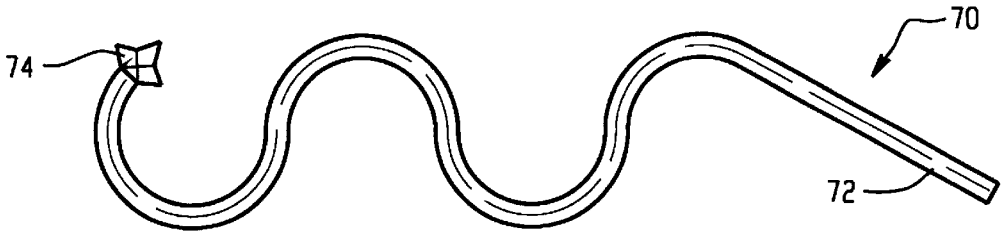
FIG. 6 shows a fourth preferred embodiment of the zigzag structure of the strain relief apparatus.

With reference to FIG. 6, yet another embodiment of a friction locking element 70 is shown. The form 70 is similar to the form 60 in that it has a straight section 72. However, instead of a loop end a barb 74 is depicted.

Figure 7:
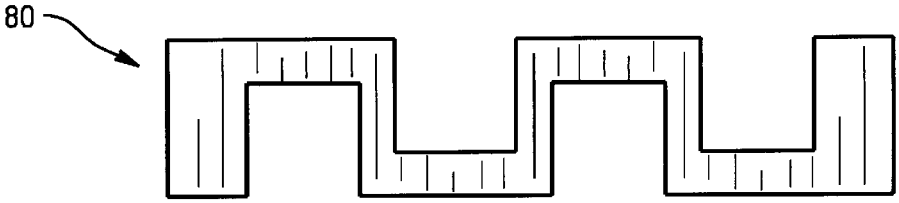
FIG. 7 shows a fifth preferred embodiment of the zigzag structure of the strain relief apparatus.

With reference to FIG. 7, still yet another embodiment of a friction locking element 80 is shown, which is a square wave form 80 with wider sides as compared with the embodiment 40 of FIG. 3.

Each of the foregoing embodiments may have particular applicability to specific situations. For example, the square wave form 40 of FIG. 3 may be used with a thinner and more flexible cord wherein the wrapping technique assists in the increasing of frictional locking. For example, for a flexible cord used with frictional locking element 40, the cord may be passed over leg 41, under leg portion 42, then over leg portion 43. The cord may then be wrapped around leg 43 coming out under its bottom side such that it can then be wrapped over leg portion 44. This pattern may be repeated to obtain a highly frictional connection. Use of locking element 40 and the wrapping technique described creates numerous contact points and angles of the cord in different planes increasing the frictional locking.

FIG. 4 may employ different wrapping techniques such as looping a cord around sections 52, to increase the frictional connection.

The embodiments of the frictional locking element shown in FIGS. 1 through 7 are exemplary only. Other variations of the frictional locking element will occur to those skilled in the art upon reading this detailed description. All such variations are intended to fall within the scope of the invention insofar as they fall within the scope of the appended claims. In particular, the straight ends, loop and barbs of FIGS. 5 and 6 may be applied to the other noted embodiments.

Figure 8:
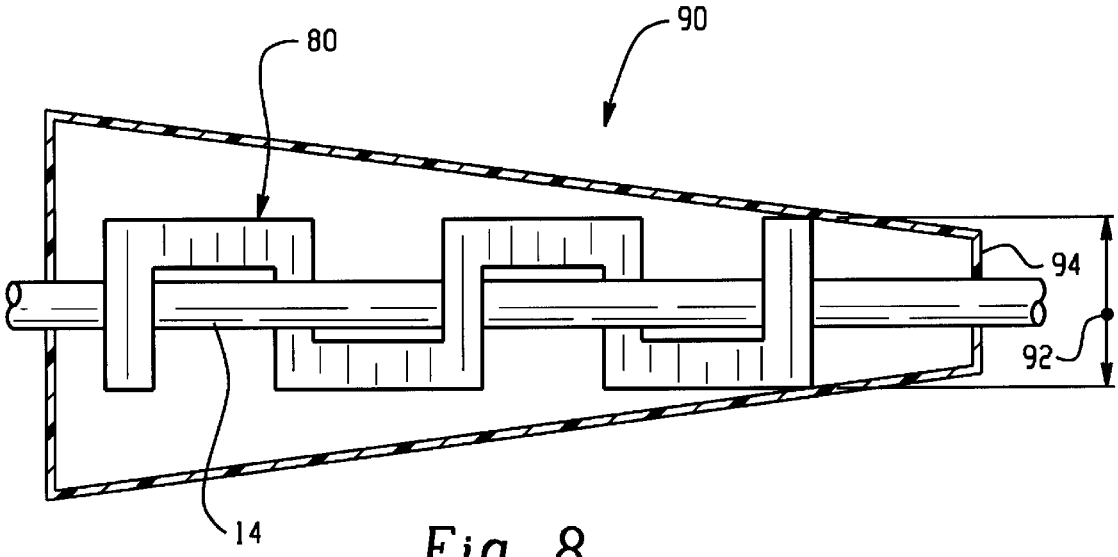
FIG. 8 shows a strain relief arrangement according to another preferred embodiment of the invention.

With reference now to FIG. 8, another conduit embodiment 90 is described. The conduit 90 narrows from the end attached to the electrical device to the distal end. The frictional locking element, e.g. the particular form 80, has a maximum width 92 that is wider than the narrow end 94 of the narrowing conduit 90. Hence, the form 80 is retained inside the conduit 90 while the cord 14 nonetheless passes through.

Figure 9:
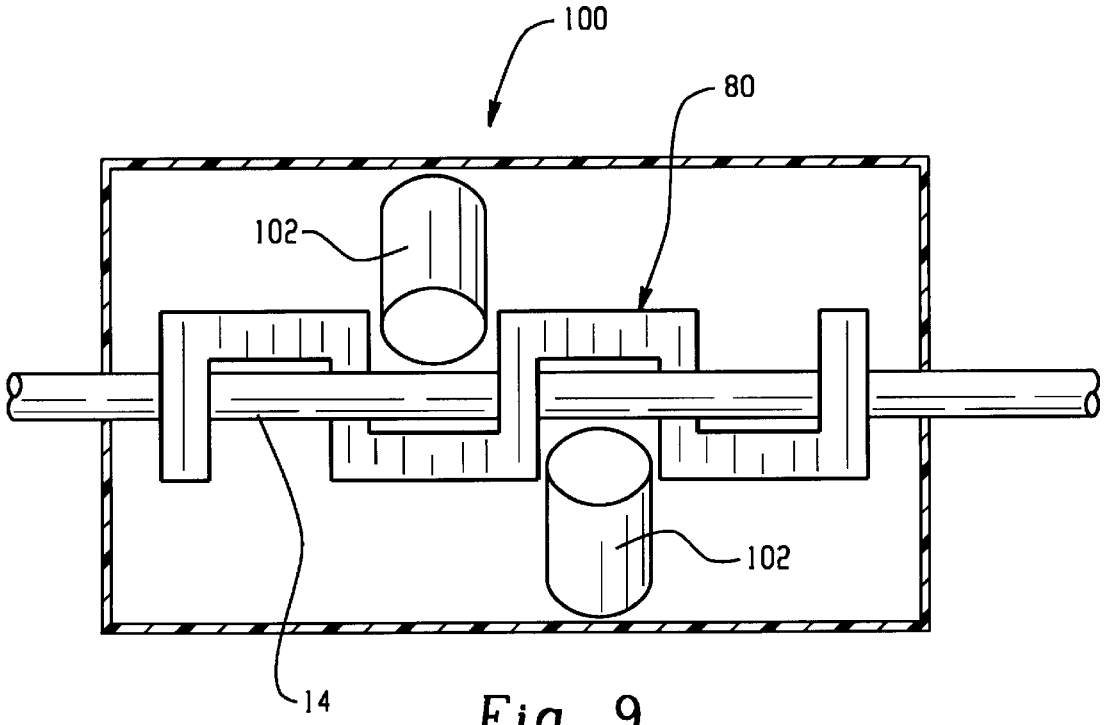
FIG. 9 shows a strain relief arrangement according to a further preferred embodiment of the invention.

With reference now to FIG. 9, yet another conduit embodiment 100 is described. The conduit 100 includes blockages 102 disposed inside the conduit 100 and attached thereto. These blockages 102 retain the frictional locking element, e.g. the particular form 80, within the conduit 100, while allowing the cord 14 to pass therethrough.

The conduit embodiments of FIGS. 1, 2, 8, and 9 are exemplary only. Other variations of the conduit will occur to those skilled in the art upon reading this detailed description. All such variations are intended to fall within the scope of the invention insofar as they fall within the scope of the appended claims.

Figure 10:
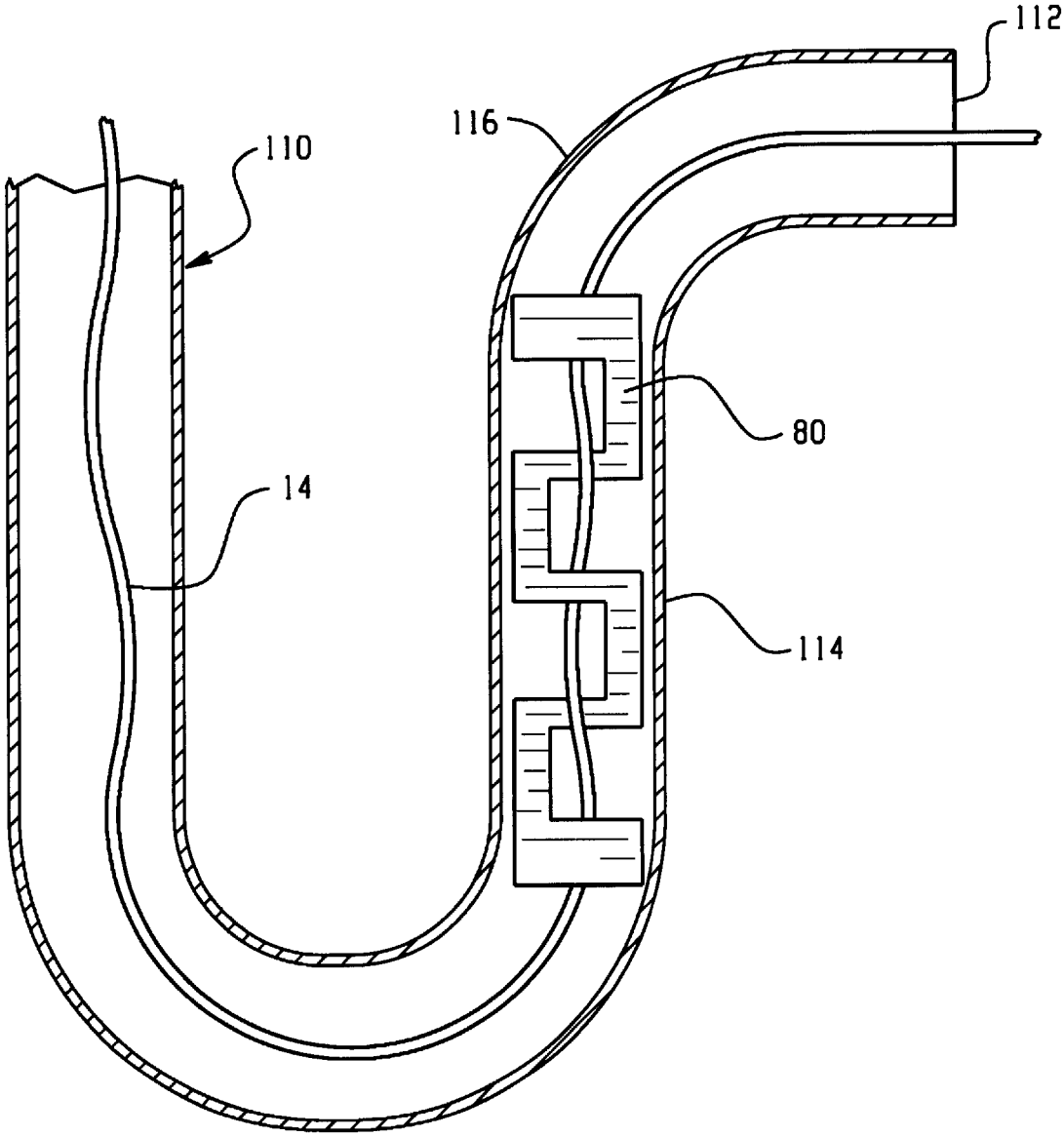
FIG. 10 shows a strain relief arrangement inside a bent conduit according to a further preferred embodiment of the invention.

With reference now to FIG. 10, another embodiment of the invention is described. An electrical cord 14 is disposed in a rigid bent conduit or hollow tube 110. The bent tube 110 could, for example, be used for hanging a lamp or lighting fixture (not shown). The electrical cord 14 passes through the hollow tube 110 and exits at an end 112 thereof. A frictional locking element 80 is disposed inside a tube portion 114 to provide strain relief for the cord 14 near the point where the cord 14 exits the bent conduit 110. A turn 116 in the hollow tube 110 near the end 112 retains the frictional locking element 80 in the bent conduit 110. Of course, it will be appreciated that the turn 116 could be replaced by a partial blockage, tube constriction, or other structure for retaining the locking element 80.

It will also be appreciated that the embodiment of FIG. 10 is exemplary only. A number of variations are contemplated, such as replacing the bent tube 110 with a tubular loop having an opening for the cord to exit, or passing the cord 14 through a hole or other opening in the bent tube 110. It will be recognized that the inventive strain relief means is applicable to the general situation of providing strain relief at an exit point of a cord from a body.

Figure 11:
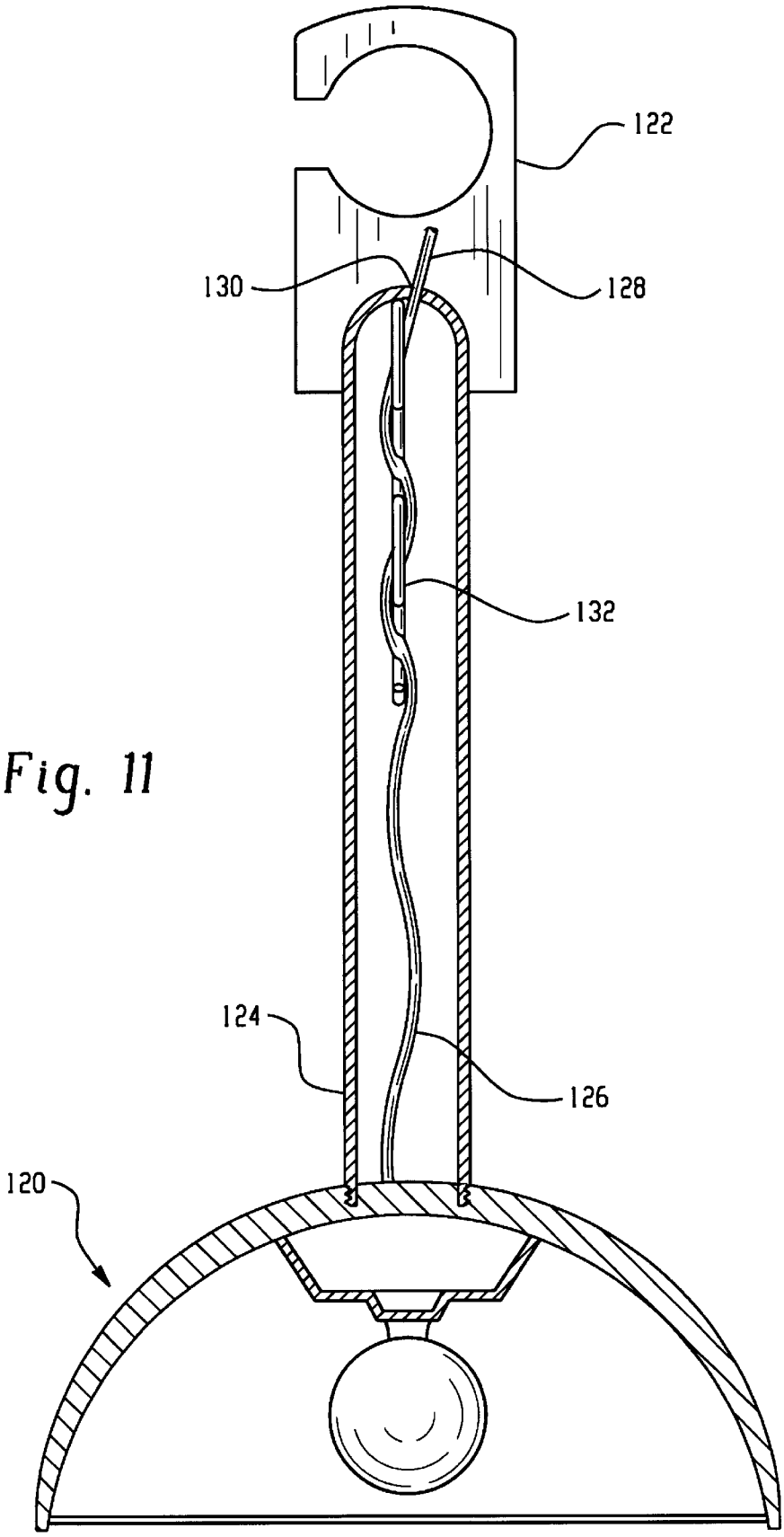
FIG. 11 shows a strain relief arrangement used in conjunction with a hook for hanging a lamp or other apparatus.
Figure 12:
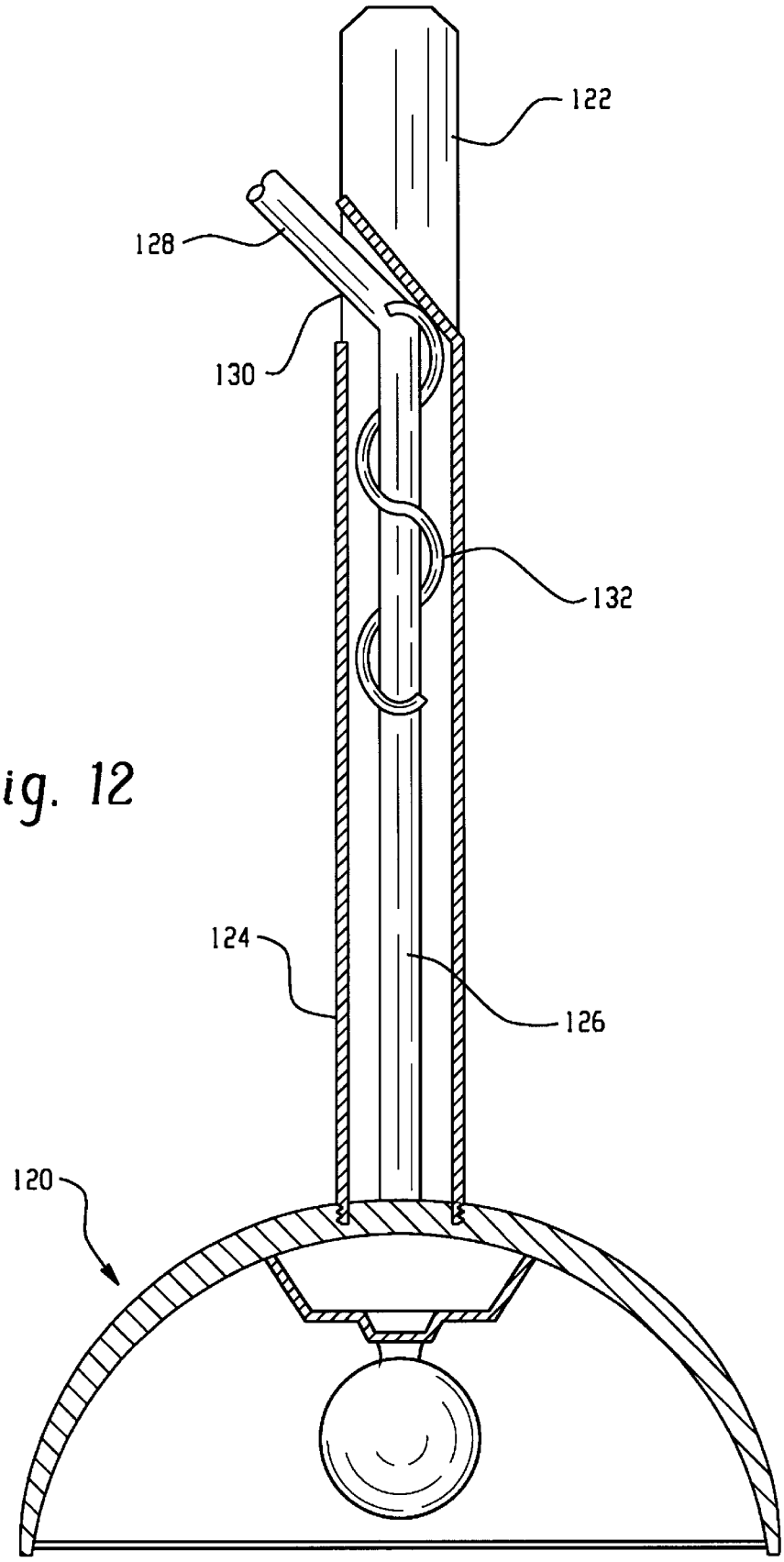
FIG. 12 shows a side view of the embodiment of FIG. 11.

With reference now to FIGS. 11 and 12, a hanging lamp 120 that suitably practices another embodiment of the invention is described. The lamp 120 is supported by a die cast hook 122 affixed to an end of a hollow conduit 124 through which the lamp cord 126 passes. The cord end 128 distal from the lamp 120 exits the conduit 124 through an opening 130 arranged just before the die cast hook 122. A frictional locking element 132 is disposed inside the conduit 124 to provide strain relief for the cord 126 near the opening 130. It will be recognized that because the opening 130 is in a side of the conduit 124 the frictional locking element 132 cannot pass through the opening 130. The arrangement of FIGS. 11 and 12 can be assembled by inserting the frictional locking element 132 through the open end of the hollow conduit 124 prior to affixing the die cast hook 122 that seals the end of the conduit 132.

Several embodiments of the inventive strain relief means have been built and tested. Several such embodiments have passed a 35 pound pull test, which consists of clamping a sample in a vice, typing a knot into the cord and pulling it for one minute with 35 pounds of force. No slippage of the cord at the opposite end of the strain relief means was observed.

The invention has been described with reference to the preferred embodiments. Obviously, modifications and alterations will occur to others upon reading and understanding the preceding detailed description. For example the present invention may be used in a non-electrical environment. It is intended that the invention be construed as including all such modifications and alterations insofar as they come within the scope of the appended claims or the equivalents thereof.

What is claimed is:

1. A strain relief apparatus for providing strain relief for an electrical cord of an electrical device wherein the electrical cord has a first end connected to the electrical device and a second end adapted to connect with a source of electrical power, the strain relief device operatively connecting with the electrical cord and the electrical device, the strain relief apparatus comprising:

a retaining conduit attached by an end thereof to the electrical device, and a zigzag shaped locking element retained within the conduit and frictionally locked onto the electrical cord.

2. The strain relief apparatus as set forth in claim 1, wherein:

the locking element comprises one of metal, rubber, and plastic material.

3. The strain relief apparatus as set forth in claim 1, wherein:

the locking element includes at least a portion having a shape corresponding to one of a sine wave, a square wave, a triangle wave, a continuously curved wave, or a "Z"-shape.

4. The strain relief apparatus as set forth in claim 1, wherein:

the locking element includes a barb or a straight section disposed at an end thereof.

5. The strain relief apparatus as set forth in claim 1, wherein:

the locking element includes a loop disposed at an end thereof.

6. The strain relief apparatus as set forth in claim 1, wherein:

the retaining conduit includes at least one of a partial blockage and a narrowing region for retaining the locking element.

7. The strain relief apparatus as set forth in claim 1, wherein:

the locking element includes a barb or a straight section at an end thereof to retain the locking element in the conduit.

8. The strain relief apparatus as set forth in claim 1, wherein the interfaces of the electrical cord and the locking element effectuate a frictional locking therebetween.

9. An electrical apparatus comprising:

an electrical device;

an electrical cord having a first end connected to the electrical device, and having a second end adapted to connect with a source of electrical power; and a strain relief device operatively connected with the electrical cord and the electrical device, the strain relief device including:

a conduit attached by an end thereof to the electrical device, and a zigzag shaped locking element retained within the conduit and frictionally locked onto the electrical cord.

10. The electrical apparatus as set forth in claim 9, wherein:

the strain relief device cooperates with the connection of the first end of the electrical cord to the electrical device to effectuate an electrical cord connection that passes a 35 pound pull test.

11. The electrical apparatus as set forth in claim 9, wherein:

the conduit includes at least one of:

a partial blockage for retaining the locking element, or a narrowing of an end distal from the end attached to the electrical device for retaining the locking element.

12. The electrical apparatus as set forth in claim 9, wherein:

the zigzag shaped locking element includes one of a barb, a loop, and a straight section at one end thereof.

* * * * *